United States Patent [19]

Chua et al.

[11] Patent Number: 4,673,897

[45] Date of Patent: Jun. 16, 1987

[54] WAVEGUIDE/MICROSTRIP MODE TRANSDUCER

[75] Inventors: Lye-Whatt Chua, South Nutfield; Peter J. Gibson, Crawley, both of England

[73] Assignee: U.S. Philips Corporation, New York, N.Y.

[21] Appl. No.: 787,002

[22] Filed: Oct. 8, 1985

Related U.S. Application Data

[63] Continuation of Ser. No. 481,709, Apr. 4, 1983, abandoned.

[30] Foreign Application Priority Data

Apr. 26, 1982 [GB] United Kingdom ..... 8211991

[51] Int. Cl.[4] ..... H01P 5/107

[52] U.S. Cl. ..... 333/26; 333/21 A; 333/33

[58] Field of Search ..... 333/26, 21 R, 21 A, 333/33, 34, 246, 248

[56] References Cited

U.S. PATENT DOCUMENTS

| | | | |
|---|---|---|---|
| 3,518,579 | 6/1970 | Hoffman | 333/21 R |
| 3,732,508 | 5/1973 | Ito et al. | 333/26 X |
| 4,157,516 | 6/1979 | Van de Grijp | 333/26 |
| 4,260,964 | 4/1981 | Saul | 333/248 X |

OTHER PUBLICATIONS

Van Heuven, J. C., "A New Integrated Waveguide-Microstrip Transition" Conference 4th European Microwave, Mortieux Switzerland (10–13 Sep. 74).

*Primary Examiner*—Eugene R. LaRoche
*Assistant Examiner*—Benny Lee
*Attorney, Agent, or Firm*—Robert J. Kraus

[57] ABSTRACT

A waveguide/microstrip mode transducer operable over a broad frequency range comprises a dielectric substrate (3) extending along an E-plane of a waveguide and having a conductive layer on each major surface, the two layers having three successive pairs of portions. A first pair (10, 11) form a microstrip line, a second pair (12, 13) form a balanced transmission line, and a third pair (14, 15) couple the portions (14, 15) of the balanced line to opposite walls (6, 7) of the waveguide. The microstrip line is coupled to the balanced line in a manner which is independent of frequency over the operating frequency range, rather than by a resonant balun; the strip conductor portion (10) and the ground plane conductor portion (11) of the microstrip line respectively are the same width as, and taper smoothly to the width of, the conductor portions (12, 13) of the balanced line connected thereto, and there are two regions (22, 23) respectively on opposite sides of the balanced line in which there is no conductor on both surfaces of the substrate (3) and which exhibit no resonance in the operating frequency range. In order to provide phase velocity matching between the waveguide and the transmission lines on the substrate (3), particularly when the substrate (3) has a high dielectric constant, the substrate (3) has a recess (24) of progressively increasing width along the waveguide.

9 Claims, 2 Drawing Figures

WAVEGUIDE/MICROSTRIP MODE TRANSDUCER

This is a continuation of application Ser. No. 06/481,709, filed Apr. 4, 1983, now abandoned.

BACKGROUND OF THE INVENTION

This invention relates to a waveguide/microstrip mode transducer comprising a waveguide and a microstrip line which is operably coupled to the waveguide over a broad frequency range via a balanced transmission line. The transducer comprises an insulating substrate which extends along the waveguide in an E-plane thereof and further comprises two conductors which are respectively on opposite major surfaces of the substrate and which have three successive pairs of portions, the two portions of each pair being respectively on the opposite major surfaces, wherein the microstrip line comprises a first of the pairs of which the two portions are respectively a strip conductor portion and a ground plane conductor portion, wherein the balanced transmission line comprises a second of the pairs of which the two portions are each elongate and are each bounded by two transversely-spaced lateral edges both substantially spaced from the walls of the waveguide, and wherein the two portions of the third pair extend away from the second pair along the waveguide to opposite wall portions thereof.

Such a mode transducer is known from U.K. Patent Specification No. 1 494 024. In this mode transducer, a substrate supporting the microstrip line and the balanced line is arranged in a longitudinal plane of symmetry of a rectangular waveguide, parallel to the electric field lines of the fundamental $TE_{10}$ mode in the waveguide. The balanced transmission line is connected at one end to the microstrip line by a balance-to-unbalance transformer (balun) comprising two slots extending into the ground plane of the microstrip line from an edge thereof that extends across the substrate perpendicular to the longitudinal axis of the waveguide. The slots are disposed one on each side of the strip conductor of the microstrip line, and the effective electrical length of each slot is approximately a quarter wavelength in the operating frequency range of the transducer. The conductors of the balanced line extend away from the microstrip line along the waveguide and in opposite directions away from the centre of the waveguide so that they are mirror images of one another, becoming progressively broader, and are coupled at R. F. to central portions of the broad walls of the waveguide.

The operation of the balun in this known mode transducer is related to the fact that the short-circuit at the closed end of each slot is transformed to an open-circuit at the mouth of the slot when the effective electrical length of the slot is exactly a quarter wavelength. R.F. current passing between the microstrip ground plane and the conductor of the balanced line connected thereto is thus constrained to flow through the ground plane longitudinally of the waveguide rather than towards the waveguide walls. However, when the operating frequency range is broad, for example a waveguide bandwidth (such as 26.5–40 GHz) or a major part thereof, the effective electrical length of each slot may differ substantially from a quarter wavelength over part of the frequency range. As a result, the impedance at the mouth of the slot will not then be very high, and the balun will not function in substantially the desired manner. In other words, the coupling between the microstrip line and the balanced line will be inherently frequency-dependent.

An improved waveguide/microstrip line mode transducer is proposed in U.K. Patent Specification No. 1 586 784. In this transducer, the microstrip line is coupled to the waveguide without an intermediate balanced line or the associated balun, and the conductor configuration is asymmetrical. The strip conductor of the microstrip line is connected by a further conductor extending therefrom to a first wall portion of the waveguide, providing an R. F.-connection therebetween. The ground plane of the microstrip line extends from a point opposite the connection of the strip conductor and the further conductor with a generally decreasing width, measured parallel to the electric field lines, to an opposite second wall portion of the waveguide and is R.F.-connected thereto, and also extends to the first wall portion with an edge of the ground plane so disposed as to form a transmission line with the trailing edge (as defined in the Specification) of the further conductor, this transmission line having a high impedance at said point in the operating frequency range. The invention is said to be based on the recognition that the conductor configuration of such a device need not be symmetrical and that the frequency-selective balance-to-unbalance transformer situated in the signal path and required as a result of the balanced line in the device known from U.K. Patent Specification No. 1 494 024 can also be avoided. However, difficulty has been experienced in reproducing the stated performance of a constructed embodiment of the later invention, and generally the performance of such an embodiment leaves something to be desired.

It may be noted that another kind of waveguide/microstrip mode transducer has been proposed by M. Arditi in Trans. IRE, Vol. MTT-3, March 1955, p 31. In this transducer, a single ridge extends along and across the waveguide from one broad wall thereof, the height of the ridge increasing progressively along the waveguide from zero to the height of the waveguide minus the thickness of a substrate carrying the microstrip line. The ground plane of the microstrip line is coplanar with and conductively connected to the broad wall of the waveguide opposite that from which the ridge extends, and the strip conductor of the microstrip line is conductively connected to the ridge. This can be both electrically and mechanically disadvantageous. The abrupt transition from the unbalanced microstrip line to the ridge waveguide and plain waveguide, in both of which propagation is normally in effectively a balanced mode, can cause some propagation along the waveguide on the outside as well as inside, which may result in loss or undesired coupling. The conductive connections between the ridge waveguide and the microstrip line, more especially the strip conductor thereof, tend to be fragile, and may easily be damaged by relative movement between the waveguide and microstrip line due, for example, to a change in temperature or to mechanical shock or vibration.

SUMMARY OF THE INVENTION

According to the invention, a waveguide/microstrip mode transducer as set forth in the opening paragraph is characterised in that the microstrip line is coupled to the balanced transmission line in a manner which is substantially independent of frequency over said broad frequency range.

The invention is based on the recognition that in order to obtain good performance, particularly a low VSWR, it is desirable for the microstrip line to be coupled to the waveguide (in which propagation is effectively in a balanced mode) via a balanced transmission line as set out in the opening paragraph so that the electric field of R.F. energy propagating through the transducer from the microstrip line to the waveguide or vice-versa can be concentrated in a balanced manner, well away from the waveguide walls, between the conductor portions of the balanced line, but that in order to maintain the performance over a broad frequency range, the microstrip line should be coupled to the balanced line without elements that inherently introduce a frequency dependence within the desired broad operating frequency range.

Suitably, the edges of said two conductors within the waveguide do not have any abrupt changes in direction. The two conductor portions of said second pair may be of substantially the same width. Suitably, there is substantially no variation in the width of the conductor comprising the strip conductor portion of the microstrip line along the waveguide from the microstrip line to the balanced transmission line.

There may be two regions in the plane of the substrate respectively on opposite sides of the balanced transmission line wherein there is no conductor on each major surface of the substrate, both regions being bounded by the ground plane conductor portion of said first pair and by said second pair of conductor portions and the two regions being respectively bounded by opposite wall portions of the waveguide and the conductor portion of the third pair extending thereto, and wherein the two regions have substantially no resonance in said broad frequency range.

Suitably, there is a progressive decrease along the waveguide from the microstrip line to the balanced line in the width of the conductor comprising the ground plane conductor portion.

The second and third pairs of conductor portions may be substantially symmetrical about a longitudinal plane normal to said E-plane.

It may be noted that another waveguide/microstrip mode transducer is disclosed in the paper "An X-Band Balanced Fin-Line Mixer" by G. Begemann, IEEE Transactions on Microwave Theory and Techniques, Vol. MTT-26, No 12, December 1978, pp 1007–1011, particularly pp 1008–1009. In this mode transducer, which utilises a tapered antipodal finline-like transition, an additional metallisation is provided in a region which is otherwise free of metal on both surfaces of the substrate in order to prevent the region from resonating in the desired operating frequency range. A further mode transducer which is similar to that one except for the absence of the additional metallisation is disclosed in the article "Shielded Microstrip Aids V-Band Receiver Designs" by M. Dydyk and B. D. Moore, Microwaves, March 1982, pp 77–82. In each of these two mode transducers, the conductor on one surface of the substrate that comprises the ground plane portion of the microstrip line extends to one of the broad walls of the waveguide throughout the whole length of the transducer, and there is therefore no balanced transmission line as set out in the opening paragraph of this specification between the microstrip line and the waveguide; the conductor configuration is inherently asymmetrical.

Suitably, a mode transducer embodying the invention wherein the substrate has recess means extending therein along the waveguide and away from the balanced transmission line is characterised in that the spacing between the respective transversely-opposed edge portions of a plurality of successive pairs of transversely-opposed edge portions of the recess means increases with increasing distance along the waveguide from the balanced transmission line whereby to reduce the dielectric loading of the waveguide therealong. This is particularly suitable when the substrate has a dielectric constant which is substantially greater than 3 and which may be much greater, for example about 10 or more. The recess means may extend to an end of the substrate remote from the balanced transmission line. Suitably, said successive pairs of transversely.opposed edge portions of the recess are contiguous one with another whereby there is a progressive increase and substantially no decrease in the width of the recess means with increasing distance along the waveguide from the balanced transmission line. To reduce the overall length of the transducer, the recess means may extend mainly or wholly between the third pair of conductor portions.

The use of a notch extending into a dielectric substrate from one end thereof, the substrate supporting a transmission line in a waveguide/transmission line mode transducer, is known from, for example, the paper "Advances in Printed Millimeter-Wave Oscillator Circuits" by L. D. Cohen, 1980 IEEE MTT-S International Microwave Symposium Digest, pp 264–266. In that case, the notch is of uniform width and is said to be a quarter-wave transformer that provides an impedance match between the air-filled and slab-loaded waveguide. Such a notch provides reflections at its open and closed ends which compensate one another at the frequency for which the effective length of the slot is a quarter wavelength. However, it does not provide the progressive change in phase velocity from the waveguide to the transmission line that is provided over a broad range of frequencies by the recess means in a mode transducer embodying the invention.

BRIEF DESCRIPTION OF THE DRAWING

Embodiments of the invention will now be described, by way of example, with reference to the diagrammatic drawings, in which.

DESCRIPTION OF THE PREFERRED EMBODIMENT

Figure 1:
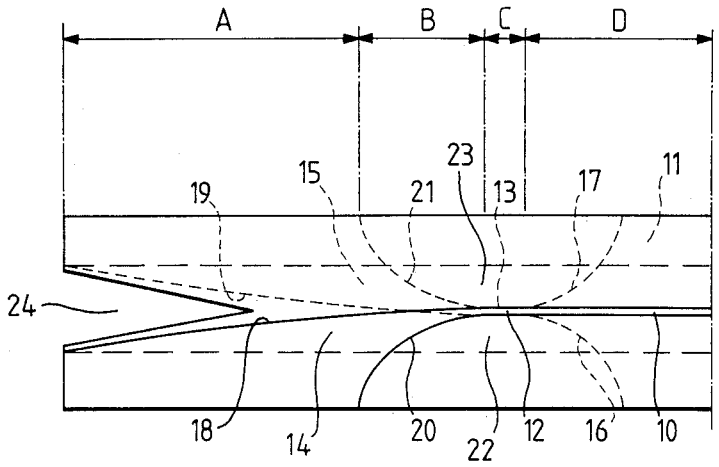
FIG. 1 is an exploded, cut-away perspective view of a mode transducer embodying the invention.
Figure 2:
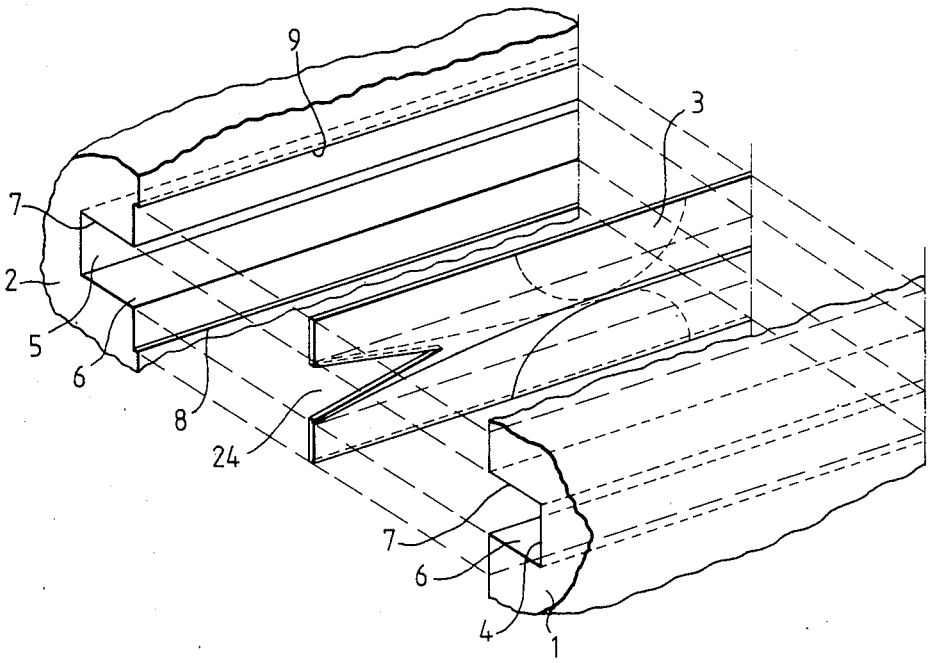
FIG. 2 is a plan view of the substrate of the mode transducer.

Referring to FIGS. 1 and 2, the exploded view of FIG. 1 indicates with long dashed lines the relative positions of components of the mode transducer when the transducer has been assembled, the components being two metal housing members 1 and 2 and a planar dielectric substrate 3 having conductive layers on each of its two opposite major surfaces. The substrate is in this case of alumina, having a dielectric constant of about 10.

The two members 1 and 2 have two respective opposed channels formed in them so that when the members are secured together (by means not shown) with the substrate 3 between them, they form a rectangular waveguide with the substrate disposed in a central longitudinal plane thereof, parallel to the narrow walls 4 and 5 of the waveguide, i e. parallel to the electric field of the fundamental $TE_{10}$ mode of the waveguide, or in other words in an E-plane thereof. The planes of intersection with the substrate 3 of the lower and upper broad walls 6 and 7 respectively of the waveguide are also indicated in FIGS. 1 and 2 by long dashed lines. The substrate is perpendicular to the broad walls of the waveguide and parallel to its narrow walls 4 and 5 and is positioned in a recess in the housing member 2, the edges of the recess being shown at 8 and 9.

The front surface of the substrate as depicted in FIG. 1 is also the front surface as depicted in FIG. 2, the edges of the conductive layer on the rear surface being indicated in each Figure by short dashed lines. The two conductive layers respectively on the front and rear surfaces have three successive pairs of portions. Going from right to left as drawn, a microstrip line comprises a first pair of portions which are a strip conductor portion 10 and a ground plane conductor portion 11 respectively on the front and rear surfaces of the substrate. These are respectively connected to a second pair of portions 12 and 13 forming a balanced transmission line, the portions 12 and 13 each being elongate and each being bounded by two transversely-spaced lateral edges which are both well spaced from the waveguide walls. These portions are in turn connected to a third pair of portions 14 and 15 which extend away from the balanced line along the waveguide to its lower and upper broad walls 6 and 7 respectively.

To inhibit the leakage of R.F. energy from the waveguide, the portions 11, 14 and 15 also extend transversely away from the hollow waveguide between the housing members 1 and 2 and terminate at the upper and lower edges of the substrate at an effective electrical distance from the adjacent broad wall of the waveguide equal to an odd integral number of quarter wavelengths at the mid-range operating frequency of the transducer. In this embodiment, the substrate is secured to the housing members 1 and 2 by soldering the housing members to the conductor portions of the substrate extending therebetween. This may be done by, for example, assembling the transducer with solder preforms (not shown) between the surfaces to be joined and heating the assembly to a temperature sufficient to melt the solder (provided of course that the other materials, particularly that of the substrate, will withstand this temperature, the substrate being for example of alumina, as in this embodiment).

As shown in FIGS. 1 and 2, the edges of the conductors on the front and rear surfaces of the substrate do not have any abrupt changes in direction that might introduce discontinuity reactances. Instead of the slotted balun of the mode transducer disclosed in the abovementioned U.K. Patent Specification No. 1 494 024, the width of the conductor on the rear face of the substrate tapers smoothly from the full height of the waveguide (and in this case from the full height of the substrate) to the width of the conductor portion of the balanced line on passing from the microstrip line to the balanced line, as indicated by the curvilinear edges 16, 17. The pair of conductor portions 12, 13 of the balanced line are of substantially the same uniform width where the conductors on the front and rear surfaces are aligned, and there is no variation in the width of the conductor on the front surface of the substrate on passing from the microstrip line to the balanced line: this helps to maintain a laminar pattern of current flow, and contrasts with the abrupt change in width of the conductor comprising the strip conductor portion of the microstrip line in the known mode transducer referred to immediately above.

On passing further to the left, the conductors on the front and rear surfaces of the substrate broaden progressively in the third pair of conductor portions 14, 15 defined by the opposed exponential leading edges 18, 19 and the curvilinear trailing edges 20, 21.

The second and third pairs of conductor portions are symmetrical about a central longitudinal plane perpendicular to the plane of the substrate. The conductor configuration is such that there are two similar, segment-like regions 22 and 23 respectively on opposite sides of the balanced line wherein there is no conductor on each major surface of the substrate. Region 22 is bounded by the tapering edge 16 of the ground plane of the microstrip line, by the lower lateral edges of the second pair of conductor portions 12, 13 forming the balanced line, by the trailing edge 20 of the conductor portion 14, and by the lower broad wall 6 of the waveguide. Region 23 is bounded by the tapering edge 17 of the microstrip ground plane, by the upper lateral edges of the second pair of conductor portions 12, 13 forming the balanced line, by the trailing edge 21 of the conductor portion 15 and by the upper broad wall 7 of the waveguide. By contrast with the somewhat similar region in the mode transducer described in the abovementioned paper by Begemann, in which additional metallisation was provided to prevent resonances in the operating frequency range, it has been found that the conductor-free regions 22 and 23 may readily be dimensioned (for example empirically) so that no resonances are apparent within an operating frequency range of a full waveguide bandwidth.

Furthermore, in order to reduce the dielectric loading of the waveguide with increasing distance along the waveguide from the balanced line and provide phase velocity matching between the transmission lines on the substrate and the waveguide, the substrate has a recess 24 therein. In this embodiment, the recess has straight edges in a V-shape and extends between the third pair of conductor portions 14, 15 through the whole thickness of the substrate to one end thereof (the left-hand end as drawn), the width of the mouth of the recess being slightly less than the height of the waveguide.

The theory of the operation of the transducer can be treated by sub-dividing it into four contiguous sections A, B, C, D respectively as indicated in FIG. 2. Consider R.F energy in the fundamental $TE_{10}$ mode of the waveguide that is incident on the substrate at section A (travelling from left to right in the Figures). The E-field, which extends in and parallel to the plane of the substrate between the upper and lower broad walls of the waveguide, is constrained between the opposed leading edges 18 and 19 of the third pair of conductor portions 14 and 15 (which may be considered to form an antipodal finline in section A). At the same time, the quantity of dielectric in the waveguide, specifically the quantity between the third pair of conductor portions, increases with increasing distance along the waveguide as the width of the recess 24 decreases, thereby assisting in progressively adapting the phase velocity of the R.F. energy from that of the waveguide to that of the twin conductor structure on the substrate.

In section B, the initially opposed leading edges 18 and 19 of the third pair of conductor portions 14 and 15 approach and then cross one another, and these conductor portions are detached from the lower and upper broad walls 6 and 7 respectively at their trailing edges 20 and 21. This section thereby forms both an impedance transformer and a polarisation twister, reducing the characteristic impedance of the transmission path (the characteristic impedance of the waveguide, for example 500 ohms, typically being much higher than that of the balanced line and that of the microstrip line) and rotating the electric field of the propagated R.F. energy out of the E-plane of the unloaded rectangular waveguide. The low output impedance of this section, i.e. adjacent the balanced line of section C, helps to reduce to a low level any R.F. energy which might tend to be propagated in the original waveguide mode.

As a result of the rotation of polarisation in section B, the polarisation of the R.F. energy entering section C is now orthogonal to the polarisation it had when incident on the transducer at section A. Consequently, the dimension of the waveguide which determines the cut-off frequency is now the width of the narrow wall rather than that of the broad wall, and thus the waveguide is cut-off for R.F. energy with the rotated polarisation. Therefore only a balanced ribbon mode of propagation occurs in this section.

In section D, the balanced line mode is progressively transformed to a microstrip mode, and the characteristic impedance is reduced approximately from 100 ohms to 50 ohms.

Either or both of the housing members 1, 2 and the substrate 3 may extend further from the balanced line/-microstrip line transition, i.e. to the right in the Figures, than drawn. The half of the hollow waveguide bounded by the housing member 2 and the microstrip ground plane 11 may be closed in any convenient manner, since no energy can propagate in it in the operating frequency range of the transducer.

The leading edges (18 and 19) of the third pair of conductor portions (14 and 15) should preferably extend smoothly up to the respective broad wall (6 and 7) of the waveguide, as in the above-described embodiment, in order to avoid inductive discontinuites.

It is considered that the width of the recess (24) should preferably vary therealong as a hyperbolic function of distance along the waveguide. However, this may, as in the above-described embodiment, be approximated by a linear variation. As a further alternative, the width may vary step-wise. Yet another alternative is to provide a series of two or more recesses spaced along the substrate, the spacing between respective transversely-opposed edge portions of successive recesses increasing with increasing distance along the waveguide from the balanced transmission line; the spacing between the transversely-opposed edge portions of each recess individually may be uniform or may itself increase with increasing distance along the waveguide from the balanced transmission line.

The recess may be formed in the substrate by cutting, for example with a laser in the case where the substrate is hard and/or brittle, or, in the case where the substrate is a ceramic formed from a particulate material, by moulding before the material is fired.

The higher the dielectric constant of the substrate, the greater should the length of the recess and its maximum width preferably be. In the above-described embodiment, the mouth of the recess is almost but not quite the full height of the waveguide. As a result, while the recess is located wholly between the third pair of conductor portions 14 and 15, thus helping to reduce the overall length of the transducer, the conductor portions 14 and 15 do not extend to the edges of the recess, thereby helping to reduce the possibility of exicting an undesired surface mode on the substrate or an undesired trapped mode between the edges of the recess.

Such a recess is particularly suitable for a mode transducer on an insulating substrate having a dielectric constant substantially greater than 3, for example quartz (the dielectric constant of which is approximately 4) or alumina. Such a substrate may be used for a microwave integrated circuit which is of low weight, compact, durable, and which can be manufactured reproducibly and fairly easily. A mode transducer embodying the invention is believed to be the first waveguide/microstrip mode transducer capable of providing a low VSWR over a broad operating range of frequencies on a substrate having a high dielectric constant.

An embodiment of the form described above with reference to FIGS. 1 and 2 has been constructed with waveguide WG 22 (WR 28) and an alumina substrate $\frac{1}{4}$ mm thick. When a iron-loaded rubber material was placed next to the strip conductor (10) of the microstrip line (this arrangement being known not to constitute a perfectly matched load) and R.F. energy fed along the waveguide to the transducer, a return loss of not less than 22 dB was measured over the full waveguide band of 26.5–40 GHz, implying a VSWR better than 1.18. Further measurements with a circuit of known return loss connected to the microstrip line of the mode transducer suggested a VSWR better than 1.10 over the full waveguide band.

In this constructed embodiment, the conductor portions (11, 14, 15) extending between the housing members (1, 2) did so up to a distance equal to three quarters of a wavelength at the mid-band operating frequency: while this gave a narrower-bandwidth choke than would have been obtained if the distance were only one quarter of a wavelength, the latter distance was considered to be too short to give the assembly high mechanical stability.

The parts of the conductor portions which extend between the housing members may, instead of being continuous, be in the form of a serrated choke.

We claim:

1. A waveguide/microstrip mode transducer comprising:

(a) a length of waveguide having opposing first and second inner walls defining an E-plane extending perpendicularly thereto;

(b) a flat substrate sheet disposed in the E-plane, said flat substrate sheet extending from a first end to a second end thereof along the length of the waveguide and extending between the first and second opposing inner walls of the waveguide; and (c) first and second conductive layers disposed on opposite flat sides of the flat substrate sheet, each conductive layer having an inner and an outer boundary defining therebetween the width of said layer;

said mode transducer comprising, from the first to the second ends of the flat substrate sheet, successive first, second, third, and fourth sections including:

(1) a first section where the first and second conductive layers each continuously increase in width with distance from the first end of the flat substrate sheet, the outer boundary of each of said first and second layers extending to and contacting a respective one of the waveguide's first and second inner walls, and the inner boundary of each of said layers, with distance from said first end, gradually approaching a central longitudinal line of said substrate sheet;

(2) a second section where the first and second conductive layers each continuously decrease in width with distance from the first end of the flat substrate sheet, the outer boundary of each of said first and second layers being spaced from a respective one of the the waveguide's first and second inner walls by a distance which increases with distance from said first end, and the inner boundary of each of said layers, with distance from said first end, continuing to approach the central longitudinal line until said first and second conductive layers overlie one another;

(3) a third section where the first and second conductive layers comprise bands covering respective areas in the centers of opposite sides of the flat substrate sheet, thereby forming a balanced transmission line; and (4) a fourth section where the first conductive layer continues as a band extending along the center of the flat substrate sheet to the second end of said substrate sheet, and where the second conductive laye gradually increases in width with distance from the first end of the substrate sheet until said width extends from the first to the second inner wall of the waveguide;

said first and second conductive layers being shaped in the third section, and in at least part of the second and fourth sections, to define conductor-free areas on opposite sides of the balanced transmission line extending from each of the first and second waveguide walls to the nearest one of said conductive layer boundaries, said conductor-free areas being dimensioned to avoid resonances in the operating frequency range of the waveguide.

2. A waveguide/microstrip mode transducer comprising:

(a) a length of waveguide having opposing first and second inner walls defining an E-plane extending perpendicularly thereto;

(b) a flat substrate sheet disposed in the E-plane, said flat substrate sheet extending from a first end to a second end thereof along the length of the waveguide and extending between the opposing first and second inner walls of the waveguide; and (c) first and second conducive layers disposed on opposite flat sides of the flat substrate sheet, each conductive layer having an inner and an outer boundary defining therebetween the width of said layer;

said mode transducer comprising, from the first to the second ends of the flat substrate sheet, successive sections including:

(1) a coupling section wheere the first and second conductive layers each continuously increase in width with distance from the first end of the flat substrate sheet, the outer boundary of each of said layers extending to and contacting a respective one of the waveguide's first and second inner walls, and the inner boundary of each of said layers, with distance from said first end, gradually approaching a central longitudinal line of said substrate sheet;

(2) an impedance transformer/polarization twister section where the first and second conductive layers each continuously decrease in width with distance from the first end of the flat substrate sheet, the outer boundary of each of said first and second layers being spaced from a respective one of the waveguide's first and second inner walls by a distance which increases with distance from said first end, and the inner boundary of each of said layers, with distance from said first end, continuing to approach the central longitudinal line until said first and second conductive layers overlie one another;

(3) a balanced transmission line section where the first and second conductive layers comprise bands of equal width covering areas in the centers of opposite sides of the flat substrate sheet, thereby forming a balanced transmission line;

(4) a microstrip line section where the first conductive layer continues as a band extending along the center of the flat substrate sheet to the second end of said substrate sheet, and where the second conductive layer gradually increases in width with distance from the first end of the substrate sheet until said width extends from the first to the second inner wall of the waveguide;

said first and second conductive layers being shaped in the balanced transmission line section, and in at least part of the impedance transformer/polarization twister and microstrip line sections, to define conductor-free areas on opposite sides of the balanced transmission line extending from each of the first and second waveguide walls to the nearest one of said conductive layer boundaries, said conductor-free areas being dimensioned to avoid resonances in the operating frequency range of the waveguide.

3. A mode transducer as in claim 1 or 2 where the width of the first conductive layer in the fourth section is equal to its width in the third section.

4. A waveguide/microstrip mode transducer as in claim 1 or 2 where said waveguide is a rectangular waveguide.

5. A mode transducer as in claim 1 where the widths of the portions the first and second conductive layers in the third section are substantially equal.

6. A mode transducer as in claim 1 where the first and second conductive layers in the first and second sections are symmetrically disposed with respect to a plane perpendicularly-intersecting the flat substrate sheet along said central longitudinal line.

7. A mode transducer as in claim 1 where the flat substrate sheet, in the first section, includes an opening disposed between areas thereof covered by the first and second conductive layers, said opening having a width which gradually decreases to zero with distance from the first end of said flat substrate sheet.

8. a mode transducer as in claim 7 where said opening extends to a maximum width at said first end of the flat substrate sheet.

9. A mode transducer as in claim 7 where the flat substrate sheet has a dielectric constant substantially greater than 3.

* * * * *